US007128590B1

(12) United States Patent
Chan

(10) Patent No.: US 7,128,590 B1
(45) Date of Patent: Oct. 31, 2006

(54) SIGNAL CONNECTOR

(75) Inventor: Yat To Chan, Taoyuan County (TW)

(73) Assignee: Joymax Electronics Co., Ltd., Taoyuan (TW)

( * ) Notice: Subject to any disclaimer, the term of this patent is extended or adjusted under 35 U.S.C. 154(b) by 0 days.

(21) Appl. No.: 11/184,920

(22) Filed: Jul. 20, 2005

(30) Foreign Application Priority Data

May 27, 2005 (TW) ..... 94208740 U

(51) Int. Cl.
*H01R 29/00* (2006.01)

(52) U.S. Cl. ..... 439/188; 200/51.1

(58) Field of Classification Search ..... 439/188, 439/944; 200/51.1
See application file for complete search history.

(56) References Cited

U.S. PATENT DOCUMENTS 3,860,317 A * 1/1975 Williams et al. ..... 439/199
4,700,678 A * 10/1987 Elliott ..... 123/297
5,401,180 A * 3/1995 Muzslay ..... 439/188
5,688,141 A * 11/1997 Dullin ..... 439/352
5,993,230 A * 11/1999 Gauker et al. ..... 439/188
6,106,314 A * 8/2000 McLean et al. ..... 439/188
6,213,800 B1 * 4/2001 Mramor ..... 439/188
6,419,510 B1 * 7/2002 Shiraki et al. ..... 439/188
6,520,785 B1 * 2/2003 Hida ..... 439/188
6,599,477 B1 * 7/2003 Miyake et al. ..... 422/64

* cited by examiner

*Primary Examiner*—Tulsidas C. Patel
*Assistant Examiner*—Harshad C Patel
(74) *Attorney, Agent, or Firm*—Bacon & Thomas

(57) ABSTRACT

A signal connector is provided according to the invention which signal connector relates to a signal connector used to connect to an electronic circuit and can be switchedly operated between two signal sources. The elements needed are simplified so that the signal connector can reduce the prime cost.

3 Claims, 4 Drawing Sheets

SIGNAL CONNECTOR

BACKGROUND OF THE INVENTION

1. Field of the Invention

The present invention generally relates to a signal connector. Particularly, the present invention relates to a signal connector that can be switchedly operated between two signal sources and can reduce the prime cost.

2. Description of Related Art

Referring to FIG. 1, a prior art signal connector is shown. The prior art signal connector essentially includes a casing 6, an electronic connector 1 that includes a conductive body 1', a first terminal 2, a metal cylinder 2*a*, a second terminal joint 3 that includes a second terminal 3', an insulation piston 4 and a spring 5. The electronic connector 1 has one end protruding out of the casing 6 to couple to an electronic circuit of a PC board (not shown). The electronic connector 1 is electrically connected to the first terminal 2 or the second terminal 3'through the conductive body 1'. The spring 5 encircles the conductive body 1' and sequentially encircles the metal cylinder 2*a* at the conductive body 1'. The metal cylinder 2*a* abuts on to one end of the first terminal 2 by the spring 5 and electrically connects to the conductive body 1'. The other end of the first terminal 2 couples to a first signal source (not shown). The piston 4 is made of insulation material and is located between the second terminal joint 3 and the metal cylinder 2*a*. The second terminal joint 3 is of tapered form and contains a second terminal 3' that is a central core-line made of metal material. The other end of the second terminal joint 3 is for inserting into a second signal source (not shown). Accordingly, when the second terminal joint 3 is inserted into the casing 6, the inserting end face of the second terminal joint 3 will abut on to the piston 4 so as to press the piston 4 to move to the spring 5 and thus pushes away the metal cylinder 2*a* to break up the electrical connection between the metal cylinder 2*a* and the first terminal 2 and, thus, break up the electrical connection between the first terminal 2 and the circuit of the PC board while an electrical connection is formed between the second terminal 3' and the electronic connector 1. Therefore, the signal transport of the first or second signal source between the electronic circuit of the PC board can swtichedly operated through the above mentioned prior art signal connector.

The prior art signal connector shown contain relatively more elements, thus its prime cost is relatively high. Therefore, it is necessary to improve the structure of the prior art signal connector.

SUMMARY OF THE INVENTION

Accordingly, one objective of the present invention is to provide a signal connector that can be switchedly operated between two signal sources. The signal connector according to the present invention concludes a hollow casing having a first hole and a second hole. An electronic connector is received in the casing and has a conductive body. The electronic connector has an end protruding out of the casing through the first hole to connect to an electronic circuit and has another end received in the casing to electrically connect to a first terminal or a second terminal. An insulation piston has a through hole to encircle the electronic connector end that protrudes out of the casing. The piston is T-like in horizontal cross-section view and has a first terminal face; and has a second terminal face in vertical cross-section view. A first terminal has an end protruding out of the casing to electrically connect to a first signal source and another end received in the casing and the first terminal has a resilient body received in the casing. The resilient body has a first resilient piece and a second resilient piece. The first resilient piece is made of conductive material and separably abuts on to the conductive body of the electronic connector to form an electrical connection therebetween. The second resilient piece so abuts on to the first terminal face that the insulation piston will not randomly move so that electrical connection between the first resilient piece and the conductive body of the electronic connector is not reversedly affected. A second terminal joint has a second terminal made of conductive material and the second terminal joint has another end so pulled to connect to a second signal source. When the second terminal joint is inserted into the casing through the second hole of the casing, the second terminal and the electronic connector are electrically connected, and the insulation piston is so pushed backward that the second terminal face of the insulation piston abuts on to the first resilient piece to push the first resilient piece away from the conductive body of the electronic connector so as to break up the electrical connection therebetween. Accordingly, the signal connector according to the present invention can be swithcedly operated with the first or the second signal sources.

Another objective of the present invention is to provide a signal connector which contains relatively fewer assembling elements and is relatively easier to manufacture and assemble. The signal connector according to the present invention concludes a hollow casing having a first hole and a second hole. An electronic connector is received in the casing and has a conductive body. The electronic connector has an end protruding out of the casing through the first hole to connect to an electronic circuit and has another end received in the casing to electrically connect to a first terminal or a second terminal. An insulation piston has a through hole to encircle the electronic connector end which protrudes out of the casing. The piston is T-like in horizontal cross-section view and has a first terminal face; and has a second terminal face in vertical cross-section view. A first terminal has an end protruding out of the casing to electrically connect to a first signal source and another end received in the casing and the first terminal has a resilient body received in the casing. The resilient body has a first resilient piece and a second resilient piece. The first resilient piece is made of conductive material and separably abuts on to the conductive body of the electronic connector to form an electrical connection therebetween. The second resilient piece so abuts on to the first terminal face that the insulation piston will not randomly move so that electrical connection between the first resilient piece and the conductive body of the electronic connector is not reversedly affected. A second terminal joint has a second terminal made of conductive material and the second terminal joint has another end to connect to a second signal source. When the second terminal joint is inserted into the casing through the second hole of the casing, the second terminal and the electronic connector are electrically connected, and the insulation piston is so pushed backward that the second terminal face of the insulation piston abuts on to the first resilient piece to push the first resilient piece away from the conductive body of the electronic connector so as to break up the electrical connection therebetween. Accordingly, the signal connector according to the present invention contains relatively fewer elements so that the manufacturing and assembling prices of it can be reduced.

The present invention can be more fully understood by reading the subsequent detailed description and examples with references made to the accompanying drawings.

DETAILED DESCRIPTION OF THE PREFERRED EMBODIMENT

Figure 1:
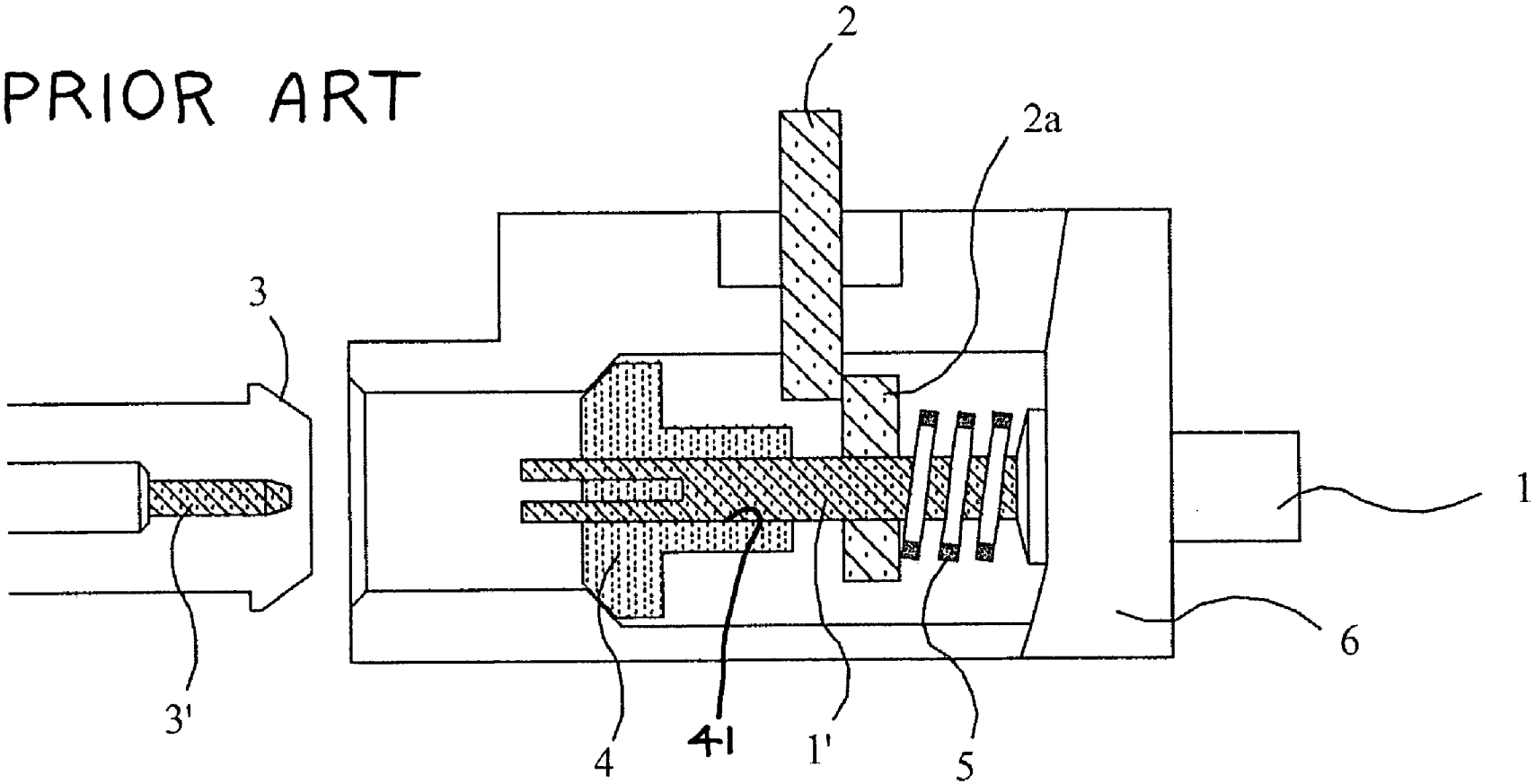
PRIOR ART Fig. 1
FIG. 1 is a cross-section view of a prior art signal connector.
Figure 2:
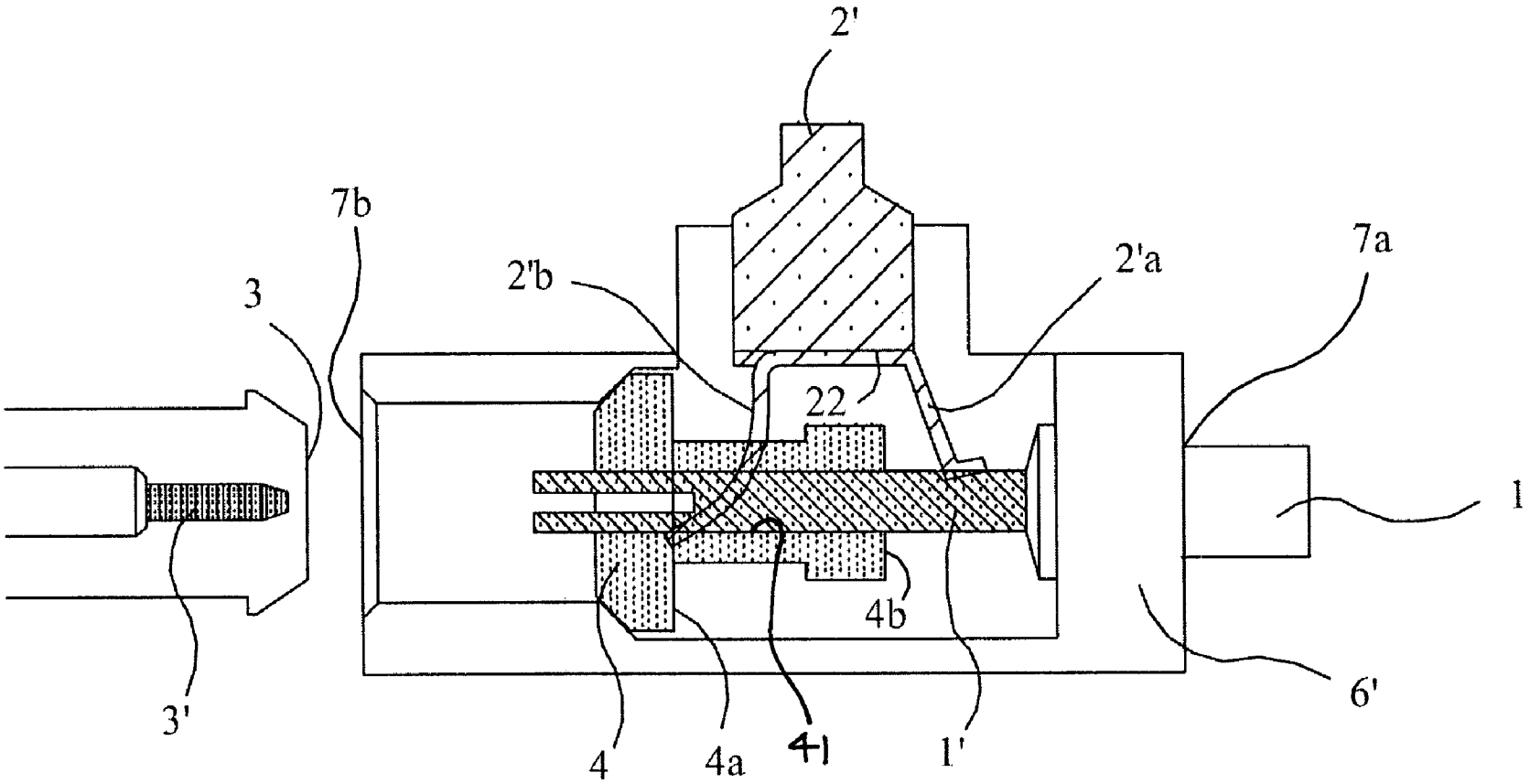
FIG. 2 is a cross-section view of the signal connector according to the present invention.
Figure 3A:
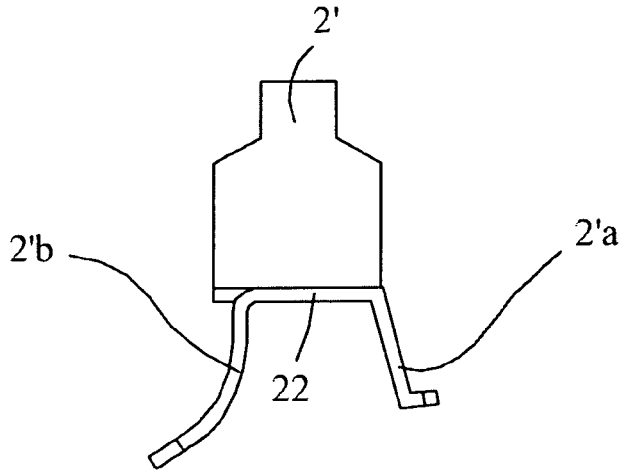
FIG. 3*a* is a cross-section view of the first terminal of the signal connector according to the present invention.
Figure 3B:
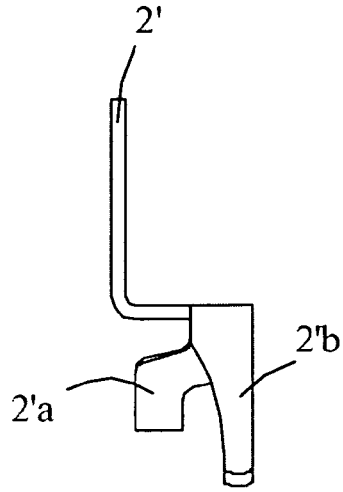
FIG. 3*b* is a cross-section view of the first terminal of FIG. 3*a* from another side.

Referring to FIG. 2, the signal connector according to the present invention essentially includes a casing 6', an electronic connector 1 having a conductive body 1', an insulation piston 4, a first terminal 2' having a resilient piece 22, and a second terminal joint 3 having a second terminal 3'.

The casing 6' is a hollow casing and includes a first hole 7*a* and a second hole 7*b*.

The electronic connector 1 includes a conductive body 1' and has one end that protrudes out of the first hole 7*a* of the casing 6'. Thus, the conductive body 1' can couple to an electronic circuit of a PC board through the first hole 7*a*. The conductive body 1' has another end received in the casing to electrically connect to the first terminal 2' or the second terminal 3'.

Figure 4:
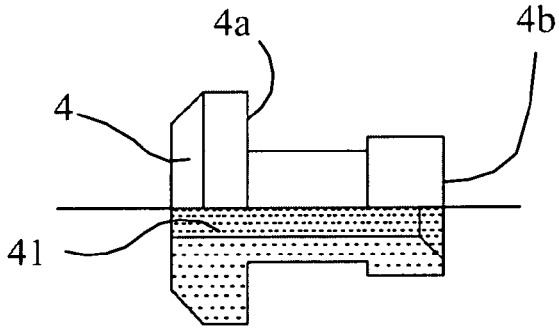
FIG. 4 is a horizontal cross-section view of the piston of the signal connector according to the present invention.
Figure 5:
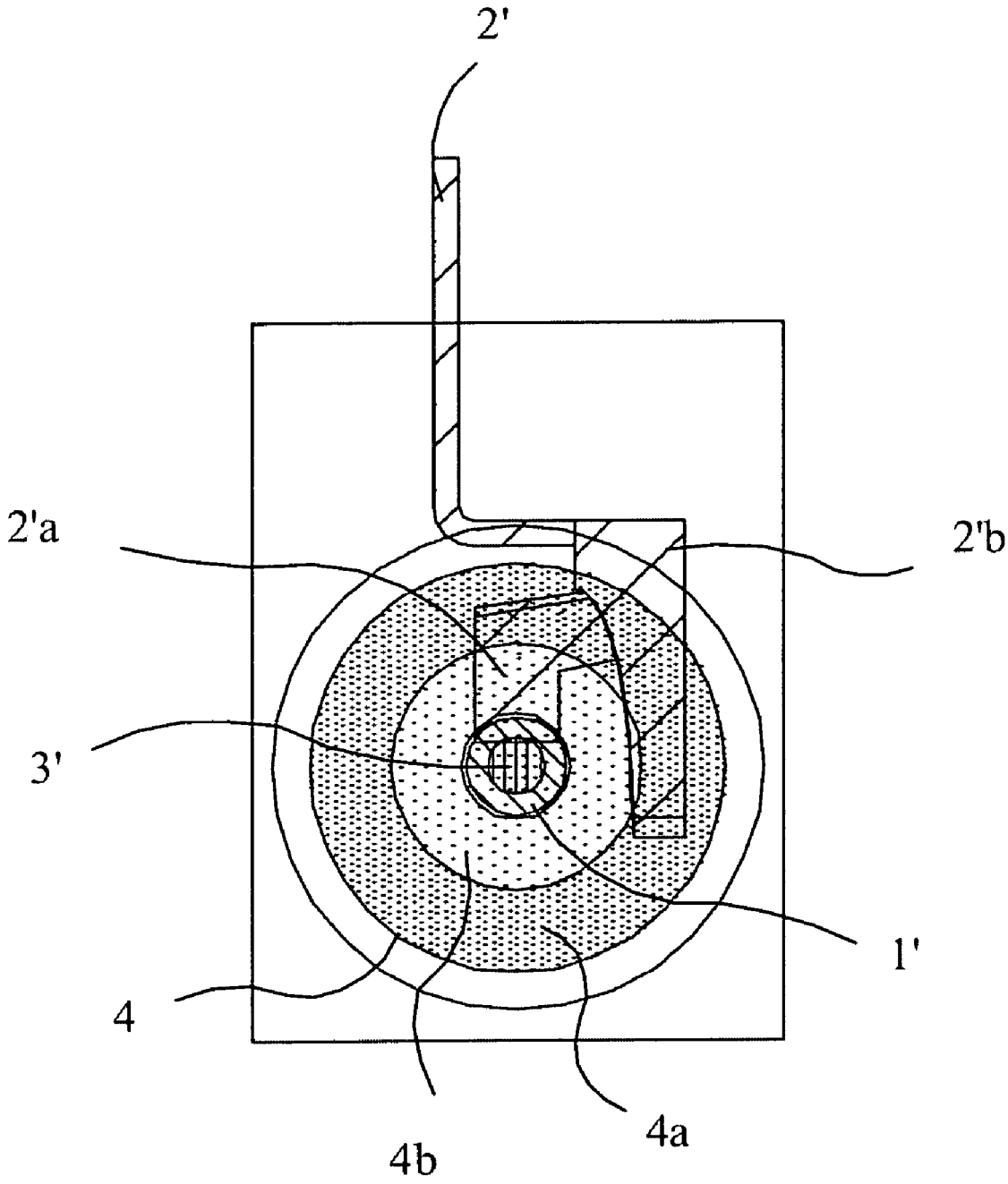
FIG. 5 is a vertical cross-section view of the signal connector according to the present invention.

The insulation piston 4 has a through hole 41 receiving the conductive body 1' of the electronic connector 1 received in the casing 6'. The piston 4 is T-like in horizontal cross-section view so that the relatively bigger end of the piston 4 can abut on to the inside wall face of the casing 6'. The piston 4 contains a first terminal face 4*a* in form of a ring and a second terminal face 4*b* in vertical cross-section view (as shown in FIG. 4).

Referring to FIG. 2, FIG. 3*a*, FIG. 3*b* and FIG. 5, the first terminal 2 includes an end protruding out of the casing 6' to electrically connect to a first signal source (not shown) and another end received in the casing 6'. The first terminal 2 includes a resilient body 22 that is made of resilient material and received in the casing 6'. The resilient body 22 includes a first resilient piece 2'*a* and a second resilient piece 2'*b*. The first resilient piece 2'*a* is made of conductive material and can separably abut on to the conductive body 1' of the electronic connector 1 to form an electrical connection therebetween. The second resilient piece 2'*b* is made of conductive or non-conductive material and the second resilient piece 2'*b* so abuts on to the first terminal face 4*a* of the piston 4 that the piston 4 will not randomly move so that electrical connection between the first resilient piece 2'*a* and the conductive body 1' of the electronic connector 1 is not reversedly affected.

Referring to FIG. 2 again, the second terminal joint 3 includes a tapered inserting end that can be inserted into the casing 6' through the second hole 7*b*. The second terminal joint 3 includes a second terminal 3' made of conductive material for using as a central core-line. The second terminal joint 3 includes another end to connect to a second signal source (not shown). When the second terminal joint 3 is inserted into the casing 6', the second terminal 3' and the electronic connector 1' are electrically connected so that the second signal source (not shown) can operate. At the same time, when the second terminal joint 3 is inserted into the casing 6', the inserting end's face pushes the piston 4 to move so that the second terminal face 4*b* of the insulation piston 4 abuts on to the first resilient piece 2'*b* to push the first resilient piece 1' away from the conductive body 1' of the electronic connector 1 so as to break up the electrical connection between the first terminal 2' and the conductive body 1'. Therefore, the first signal source (not shown) that was originally connected to the first terminal 2' is out of function.

Therefore, when the electronic connector 1' according to the present invention is used, the first signal source and the second source can be swithedly operated. Furthermore, as shown in FIG. 2, the first terminal 2' according to the present invention can associate with the resilient piece 22 (including the first resilient piece 22*a* and the second resilient piece 22*b*) to form a single element which is similar to a simplified element assembled by the first terminal 2, metal cylinder 2*a* and spring 5 according to the prior art electronic connector. Therefore, the prime cost is reduced.

As described in the above specification of the preferred embodiment, the first terminal 2' and the second terminal 3' are used as input ends; and the electronic connector 1' is used as an output end. However, the present invention substantially includes an equipment which includes an electronic connector 1' as an output end and a first terminal 2' and a second terminal 3' both as input ends. Thus, the technology shown in the preferred embodiment does not intend to limit the scope of the present invention and anyone who is skilled in the field of the present invention can made any slight alteration or modification without leaving the spirit of the scope of the present invention. Thus, the scope of the present invention shall be limited by the following claims.

What is claimed is:

1. A signal connector, comprising:

a hollow casing having a first hole and a second hole;

an electronic connector received in the casing and having a conductive body, the electronic connector having an end protuding out of the casing through the first hole to connect to an electronic circuit and having another end received in the casing to electronically connect to a first terminal or a second terminal;

an insulation piston disposed in the casing and having a through hole receiving the conductive body of the electronic connector, the piston being T-like in horizontal cross-section view and having a first terminal face and a second terminal face in vertical cross-section view;

the first terminal having an end protuding out of the casing to electrically connect to a first signal source and another end received in the casing and the first terminal having a resilient body in the casing, the resilient body having a first resilient piece and a second resilient piece, the first resilient piece being made of conductive material and separably abutting on to the conductive body of the electronic connector to form an electrical connection therebetween, the second resilient piece abutting on to the first terminal face so that the insulation piston will not randomly move and that electrical connection between the first resilient piece and the conductive body of the electronic connector is not reversedly affected;

the second terminal joint having a second terminal made of conductive material and the second terminal joint having another end so pulled to connect to a second signal source; and wherein when the second terminal joint is inserted into the casing through the second hole of the casing, the second terminal and the electronic connector are electrically connected, and the insulation piston is so pushed backward that the second terminal face of the insulation piston abuts on to the first resilient piece to push the first resilient piece away from the conductive body of the electronic connector so as to break up the electrical connection therebetween.

2. The signal connector as claimed in claim 1, wherein the second resilient piece is fixedly connected to the first terminal face of the insulation piston.

3. The signal connector as claimed in claim 1, wherein the second resilient piece is made of non-conductive material.

* * * * *